US010233012B2

(12) United States Patent
Wentz et al.

(10) Patent No.: US 10,233,012 B2
(45) Date of Patent: Mar. 19, 2019

(54) PACKAGED TISSUE PRODUCTS

(71) Applicant: Kimberly-Clark Worldwide, Inc., Neenah, WI (US)

(72) Inventors: Amie Mae Wentz, Hortonvile, WI (US); Jacob Louis Winston-Galant, Commerce Township, MI (US); Kimberly Ann Malec, Bentonville, AR (US); Lauren Spencer McClure, Fayetteville, AR (US); Joseph Ralph Bennett, Marquette, MI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 282 days.

(21) Appl. No.: 15/119,601

(22) PCT Filed: Feb. 28, 2014

(86) PCT No.: PCT/US2014/019388
§ 371 (c)(1),
(2) Date: Aug. 17, 2016

(87) PCT Pub. No.: WO2015/130305
PCT Pub. Date: Sep. 3, 2015

(65) Prior Publication Data
US 2017/0057733 A1 Mar. 2, 2017

(51) Int. Cl.
*B65D 71/00* (2006.01)
*B65D 85/62* (2006.01)
(Continued)

(52) U.S. Cl.
CPC ..... *B65D 85/62* (2013.01); *A47K 10/34* (2013.01); *B65D 25/54* (2013.01); *B65D 65/02* (2013.01);
(Continued)

(58) Field of Classification Search
CPC ..... B65D 25/54; B65D 65/02; B65D 71/08; B65D 71/063; B65D 75/04; B65D 85/62; B65D 85/66; B65D 85/67; B65D 85/672
(Continued)

(56) References Cited

U.S. PATENT DOCUMENTS 3,770,118 A * 11/1973 Jones ..... B65D 75/54 206/226
4,595,093 A * 6/1986 Eckstein ..... B65D 71/066 206/391
(Continued)

FOREIGN PATENT DOCUMENTS

DE 20 2011 051 606 U1 11/2011
JP 2006-347581 A 12/2006
(Continued)

*Primary Examiner* — Luan K Bui
(74) *Attorney, Agent, or Firm* — Kimberly-Clark Worldwide, Inc.

(57) ABSTRACT

A unitary package including a rolled tissue product and a packaged tissue product overwrapped with a packaging film. The packaged tissue product may be disposed in a box body which is in-turn co-packed with the rolled tissue product to increase the stability of the package. The rolled tissue products preferably comprise a dry tissue web wound about a core. The packaged tissue product preferably comprises a stack of tissue sheet products and more preferably a stack of wet tissue sheet products.

15 Claims, 6 Drawing Sheets

(51) Int. Cl.

| | |
|---|---|
| ***B65D 71/06*** | (2006.01) |
| ***A47K 10/34*** | (2006.01) |
| ***B65D 25/54*** | (2006.01) |
| ***B65D 65/02*** | (2006.01) |
| ***B65D 75/58*** | (2006.01) |
| ***B65D 77/00*** | (2006.01) |
| ***B65D 85/671*** | (2006.01) |

(52) U.S. Cl.
CPC ..... *B65D 71/063* (2013.01); *B65D 75/58* (2013.01); *B65D 77/003* (2013.01); *B65D 85/671* (2013.01)

(58) Field of Classification Search
USPC ..... 206/225, 226, 233, 391, 394, 410, 497, 206/581
See application file for complete search history.

(56) References Cited

U.S. PATENT DOCUMENTS 5,685,428 A 11/1997 Herbers et al.
6,021,890 A * 2/2000 Focke ..... B65B 11/58 206/391
7,621,397 B2 11/2009 Boudrie et al.
2004/0200752 A1* 10/2004 Poli ..... B65D 71/08 206/497
2004/0251292 A1 12/2004 Grebonval et al.
2007/0084741 A1* 4/2007 Dall'Omo ..... B65D 75/38 206/391
2007/0100692 A1 5/2007 Minifie et al.
2008/0078685 A1* 4/2008 Patterson ..... B65D 5/4204 206/391
2008/0135442 A1* 6/2008 Snell ..... A61F 13/15747 206/570
2008/0202964 A1 8/2008 Knobloch et al.
2008/0264824 A1 10/2008 Alejandra
2008/0264828 A1 10/2008 Benson et al.
2010/0084295 A1* 4/2010 Eilert ..... B65D 75/566 206/391
2012/0205272 A1* 8/2012 Heilman ..... B65D 75/38 206/386
2013/0206640 A1* 8/2013 Mann, Jr. ..... A45C 11/008 206/581

FOREIGN PATENT DOCUMENTS

JP 2007-153383 A 6/2007
KR 20-0364551 Y1 10/2004
KR 10-2010-0004372 A 1/2010

* cited by examiner

PACKAGED TISSUE PRODUCTS

BACKGROUND

Rolled tissue products, such as toilet tissue, paper towels, and the like, are typically packaged and marketed in multi-packs, with six or more rolled products packaged together in a single package. Packaging typically consists of an outer covering composed of a plastic film in the form of a bag housing a plurality of rolls. Typically the tissue rolls, having a cylindrical shape, are arranged side-by-side, in lateral contact and with their axes parallel, to form a called layer. A layer can comprise a single row of rolls or two or more rows of rolls located one behind the next. A single layer, for example made up by two rows each comprising 5 rolls, can be encased into a plastic material sheet to form a package containing 10 rolls in total. Another kind of known package consists of two or more layers of rolls placed one on the top of the other, forming the so called "bundle" which is then wrapped.

Unlike rolled tissue products, sheets of tissue product are typically stacked and placed within a semi-rigid package, such as a container or carton, for shipping, storage, sale, and dispensing. In certain instances multi-packages of tissue sheet product may be bundled together and overwrapped with a film to form a unitary package.

In an increasingly demanding and competitive retail environment, there is a need for unique package and merchandising solutions critical to delivering on key customer desires, leveraging consumer insights, and delivering on the overall objectives of a business, while also delivering improved environmental sustainability. More particularly there remains a need in the art for co-packaged goods and more specifically co-packaged wet and dry tissue products.

SUMMARY

The present invention provides a unique packaging, distribution, and merchandising solution that supports new business ventures with retailers and customers. More particularly, the present invention relates to improved configurations for packaging, shipping and displaying rolled and stacked tissue products. The improved packaging reduces the time necessary for shipping and handling and also reduces the amount of packaging materials used, thus reducing the cost to put a product on a retail shelf. For example, in certain embodiments the present invention provides a unitary package for tissue products and more preferably a combination of rolled and stacked tissue products and still more preferably a combination of dry rolled tissue product and packaged wet tissue products. Accordingly, in one embodiment the present invention provides a package of tissue products comprising a packaged tissue product, rolled tissue products and a packaging film covering at least a portion of the packaged tissue product and at least one of the rolled tissue products.

In other embodiments the present invention provides a unitary package of tissue products comprising a packaged tissue product, a plurality of dry rolled tissue products and a packaging film wherein the packaging film completely surrounds the packaged tissue product and plurality of rolled tissue products and at least two dry rolled tissue products and the packaged tissue product form one peripheral edge of the unitary package.

In still other embodiments the present invention provides a four-sided package of tissue products comprising a packaged tissue product, a plurality of dry rolled tissue products and a packaging film housing the packaged tissue product and the plurality of dry rolled tissue products wherein at least three sides are formed by dry rolled tissue products.

In other embodiments the present invention provides a unitary package comprising a packaged tissue product and a plurality of dry rolled tissue products, wherein the packaged tissue product is disposed in a box body having at least three sides and the box body and the plurality of dry rolled tissue products are arranged such that at least one rolled tissue product contacts each of the three box body sides.

In yet other embodiments the present invention provides a unitary package of rolled tissue products and a package of wet tissue product, the unitary package including two package sides, a package bottom, a package back, and a package top; a package front in a generally vertical orientation, the package front spaced apart from and generally parallel to the package back, wherein the package front and the package back are coupled to and generally orthogonal to the package bottom, a plurality of tissue rolls, each tissue roll having a roll height, a roll diameter, and a longitudinal axis, wherein each of the longitudinal axes are generally vertical, a packaged good comprising wet tissue product, and a bag disposed continuously over the rolled tissue product and the packaged good, the bag forming the outer face of the unitary package.

DETAILED DESCRIPTION

Embodiments of the package for tissue products (hereinafter also referred to simply as "package") according to the present invention are explained hereinafter with reference to the drawings. As used herein and unless otherwise described, the term "width" generally refers to the longest horizontal dimension of a structure, the term "height" generally refers to the vertical dimension of a structure, and the term "depth" refers to the shortest horizontal dimension of a structure. The package generally comprises a collection of product items that are to be packaged as a single unit. In a particularly preferred embodiment the package comprises at least two different products, where one product is a rolled tissue product and the other product is a stacked tissue product disposed in a carton or dispenser.

Figure 1:
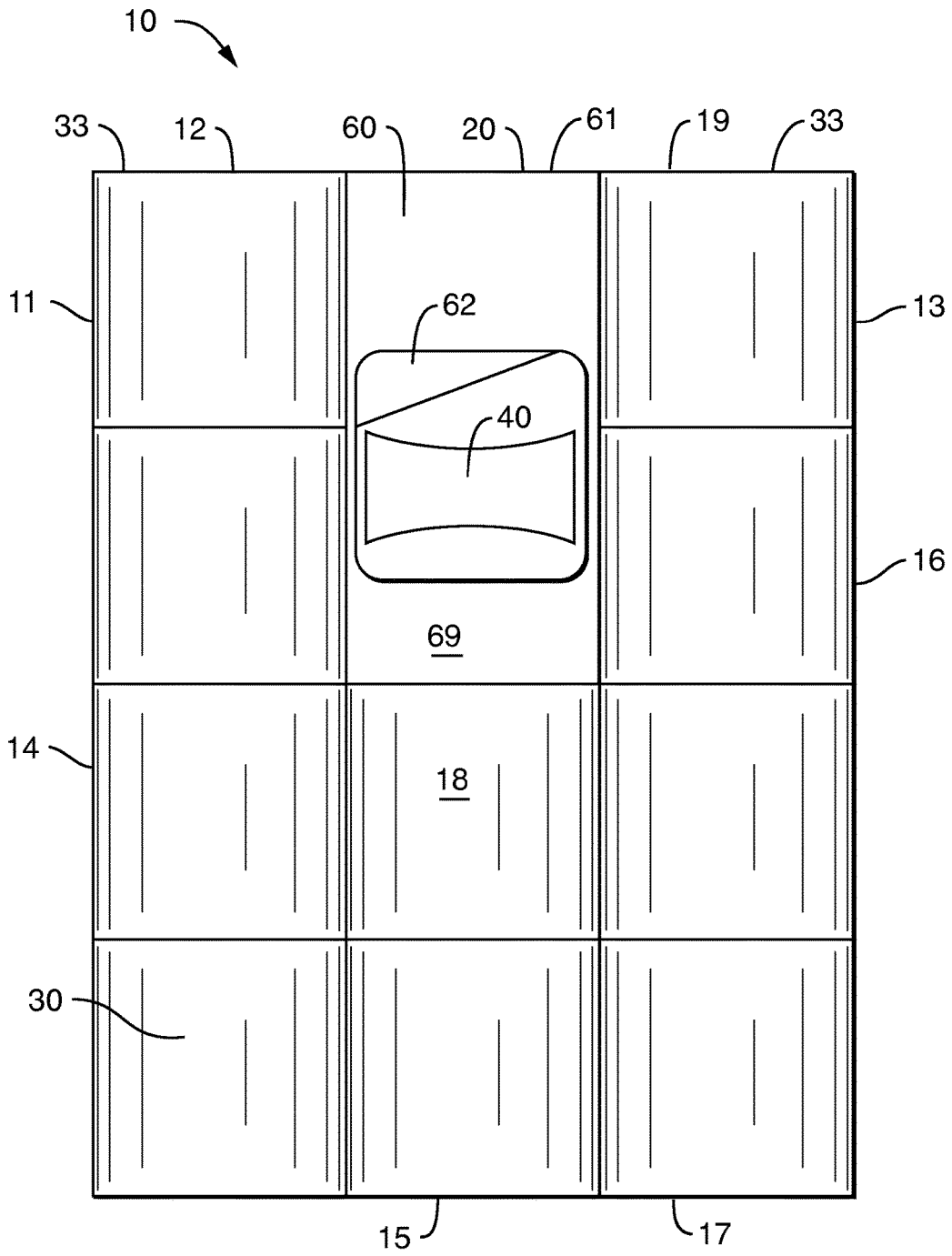
FIG. 1 is a front view illustrating one embodiment of a unitary package according to the present invention.
Figure 2:
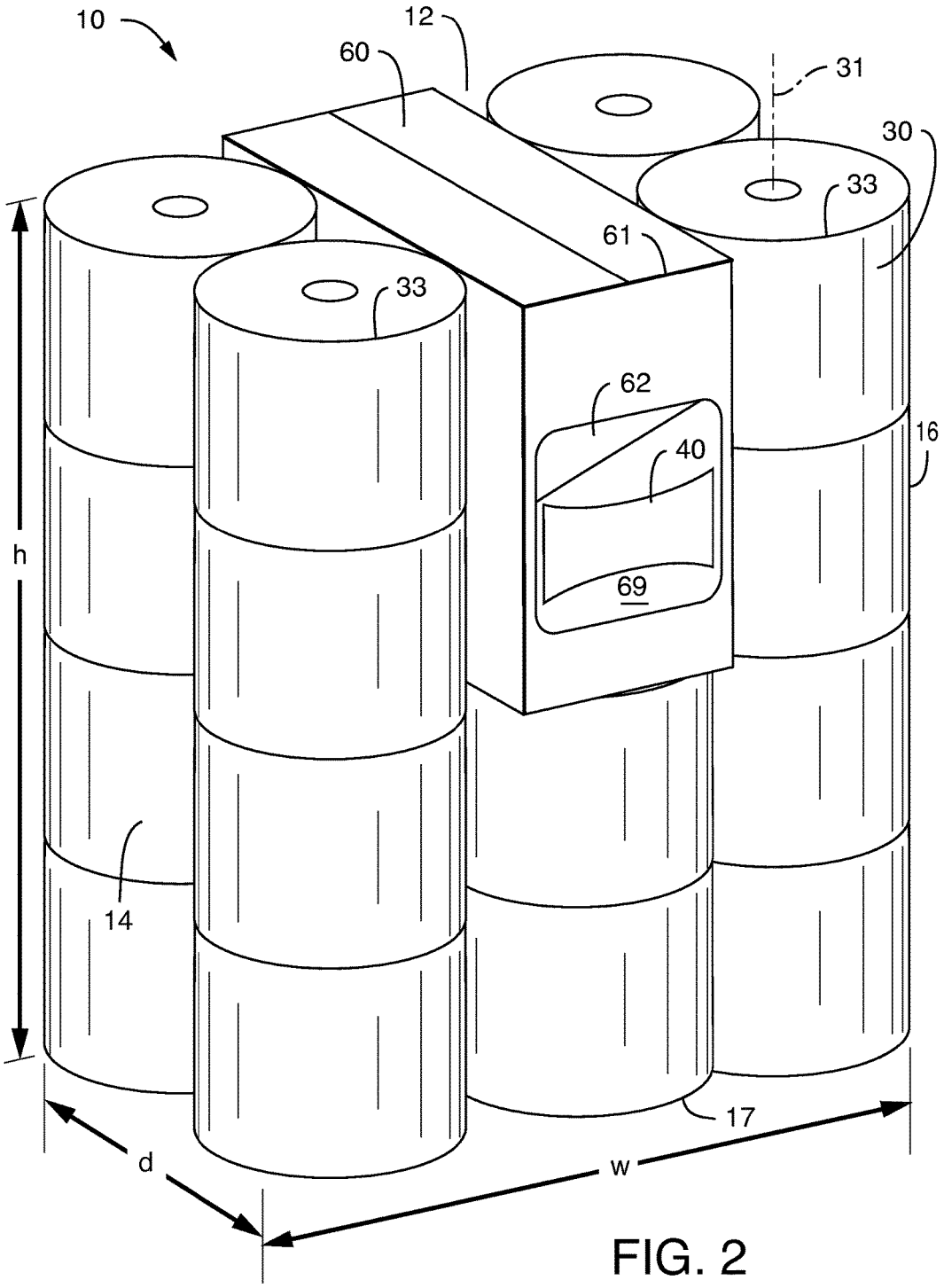
FIG. 2 is a perspective view illustrating one embodiment of unwrapped tissue products according to the present invention.
Figure 3:
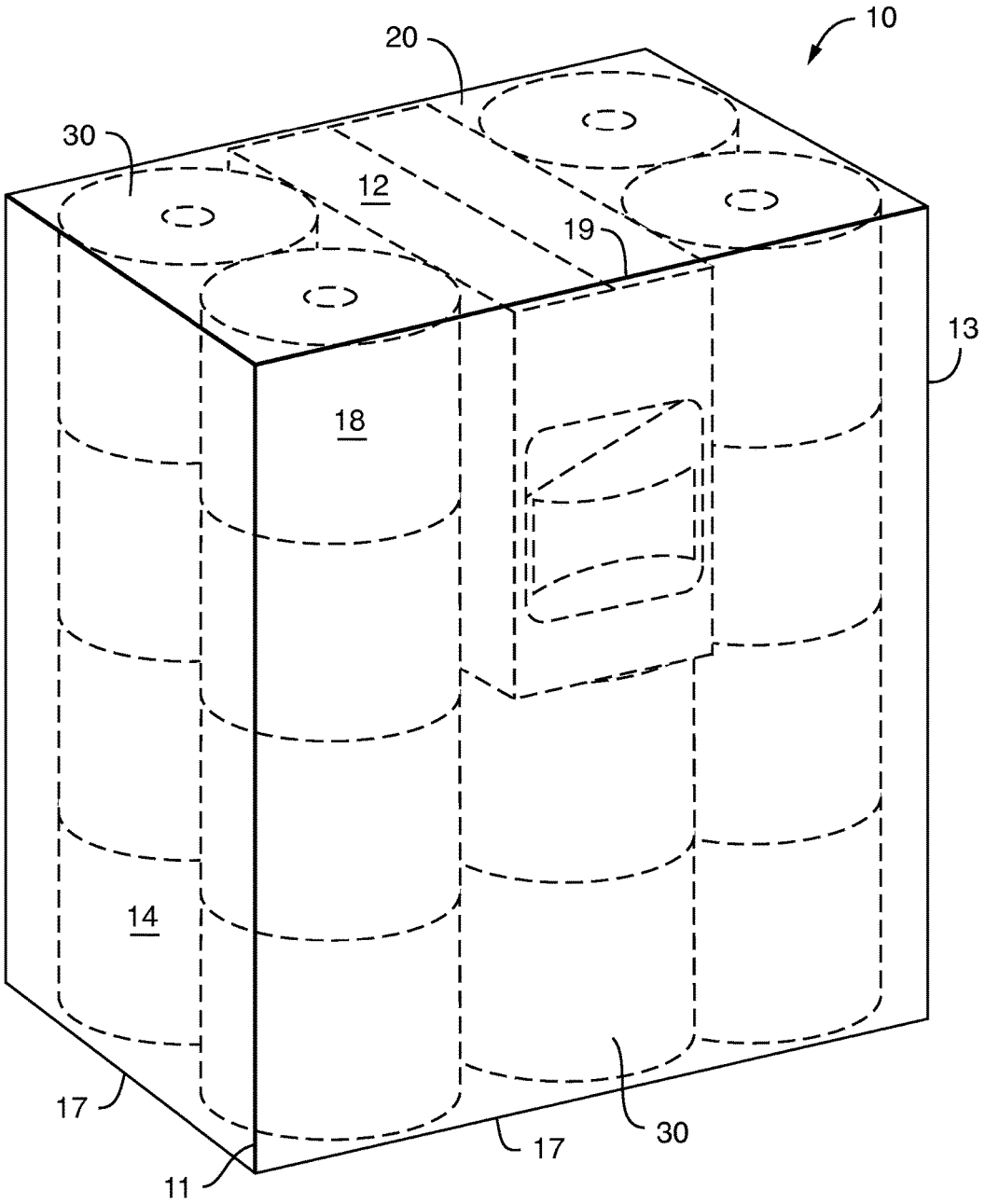
FIG. 3 is a perspective view illustrating one embodiment of a unitary package according to the present invention.

Now with reference to FIGS. 1-3, the package 10 is represented as a single outline having a cube shape that has top 12 and bottom (not illustrated) faces and opposing side faces 14, 16 front 18 and back (not illustrated) side faces. The package front 18 includes a package front width (w) and a package front height (h). The package bottom includes a package bottom depth (d), as illustrated in FIG. 2. Although the illustrated package has a cubic shape, the shape of the package 10 is not limited to being a cube shape and may be of any shape defined by the respective product items being packaged together.

With further reference to the figures, the package 10 has top 12 and front 18 faces and comprises a plurality of rolled tissue products 30, twenty in the illustrated embodiment, and a package of wet wipes 40 disposed in a box body 60. The box body 60 and rolled tissue products 30 stacked so to form columns and rows. The arrangement of rolled tissue products 30 and box body 60 relative to one another is not limiting. Arrangements other than those illustrated in FIGS. 1-3 are contemplated and will be described herein.

The tissue rolls 30 and box body 60 are surrounded by a packaging film 20. Although the packaging film 20 substantially encloses the tissue rolls 30 and box body 60 in the illustrated embodiment, the invention is not so limited. The film 20 may be in the form of a band for example, so long as the tissue rolls 30 and box body 60 are contained within the packaging film 20 in a stable manner. In such an embodiment, the packaging film 20 encloses the lateral sides of tissue rolls 30 and box body 60 to form a unitary package. Thus, the top 12, front 18 and the opposing bottom and rear faces (not visible) of the package 10 would be covered by the film wrapper 20, but the opposing side faces 14, 16 could remain entirely free of packaging film 20 or could be partially covered by the packaging film 20. Further, while the film 20 may form the outer surface of the package 10, one skilled in the art will appreciate that the surfaces or faces of the package 10 are defined by the contents—the rolled tissue products, packaged tissue products and/or box body.

The packaging film 20 is preferably a plastic film, and more preferably a thermoplastic film with the thermoplastic being either a monolayer or a laminate. Useful monolayer or laminate thermoplastic materials include polyethylenes and ethylene copolymers, polypropylenes and propylene copolymers, polyethylene terephthalates, vinyl polymers and copolymers and acrylic polymers and copolymers. The laminates include thermoplastic/paper laminates. A useful thermoplastic is biaxially oriented polypropylene. The invention is not limited to a plastic as the packaging film 20 may be a paper over-wrap or other material. In addition, the over-wrap can fully enclose the rolled tissue product 30 and packaged tissue product 40 as is shown in FIG. 1 or it can be a band enclosing the lateral sides but with the ends open.

In embodiments where the packaging film 20 material is a plastic film, it will preferably have a gram weight/square meter (gsm) of about 15 gsm to about 75 gsm. The film material 132 will generally have a thickness of about 300 microns to about 600 microns. The film wrapper 132 material preferably will be a shrink wrap material.

In the illustrated embodiments the package 10 comprises a packaging film 20 surrounding a plurality of rolled tissue products 30 and a packaged tissue product 40 disposed in a box body 60. The packaging film 20 completely surrounds the tissue products forming a unitary package 10 where the packaging film 20 forms the outer face of the package 10. In this manner the package 10 has a top face 12, opposed side faces 14, 16, a front face 18, a bottom face and a back face (not illustrated). As noted previously, although the packaging film is illustrated as completely surrounding the tissue products, the invention is not so limited. Moreover, while in certain preferred embodiments the packaging film 20 forms the face of the package it will be understood from the present disclosure that the overall shape, faces and edges of the package are defined by the package contents, i.e., the rolled tissue products and the packaged tissue product and/or box body.

In a particularly preferred embodiment, such as that illustrated in FIG. 3, the packaging film 20 extends continuously over the rolled tissue products 30 and the box body 60 to form a unitary package 10 having a generally cubic shape. The side peripheral edges 11, 13 are defined by the rolled tissue products 30. The bottom peripheral edge 17 is also defined by the rolled tissue products 30. The upper peripheral edge 19 is defined in-part by the box body 60, which houses the packaged tissue product 40, and the rolled tissue product 30. As discussed further below, however, one skilled in the art will appreciate that other arrangements of rolled tissue product; box body and packaged tissue product are possible and will determine which product forms a portion of the peripheral edge of the package.

In certain embodiments, such as those illustrated in FIGS. 1-3, the package 10 contains a packaged tissue product 40 disposed in a box body 60. The illustrated box body 60 has a front panel 69 and an opening 62 through which the packaged tissue product 40 is visible. In the illustrated embodiment the box body 60 is positioned between four rolled tissue products and above one rolled tissue product. The illustrated arrangement is such that the top edge 61 of the box body and the top edge 33 of the two adjacent rolled tissue products form the package's upper peripheral edge 19.

In a particularly preferred embodiment when the rolled tissue products 30, packaged tissue product 40 and optionally box body 60 are packaged together and overlapped with film 20 the rolled tissue products 30 comprise at least a portion of each peripheral edge of the package 10.

In certain embodiments the top edge of the packaging film includes an upper sealed portion to seal the package. As described below, in certain embodiments the upper sealed portion results from the joining of the tube-like sheet material used to form the packaging film. In a particularly preferred embodiment the upper sealed portion is formed in a central part of the upper face of the packaging film 20 and extends in a direction across both the rolled tissue products and the packaged tissue products.

Figure 4:
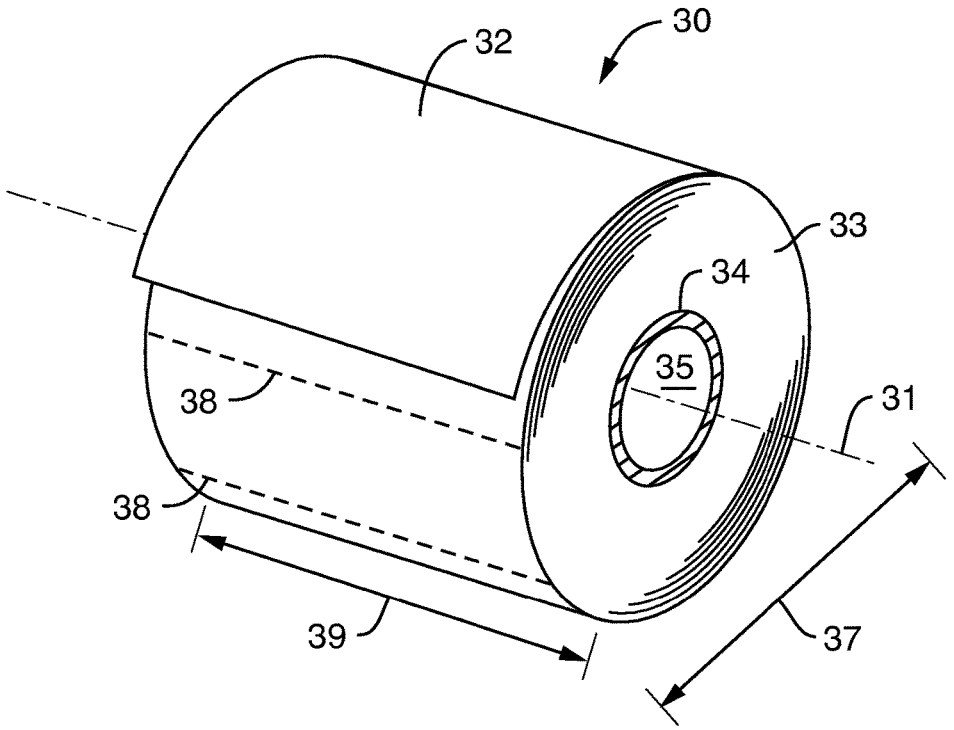
FIG. 4 is a perspective view of a roll of tissue that may be useful in assembling the package of the present invention.

With reference to FIG. 4, one of the contents of the package is illustrated in greater detail. Illustrated in FIG. 4 are consumer-oriented rolled tissue products 30 also referred to herein as tissue rolls, which include paper towels and bath tissue, also known as toilet paper and by other names. Each tissue roll 30 is generally cylindrical in shape with a roll height 39 and a roll diameter 37. The tissue roll 30 has a central longitudinal axis 31 there-through and an outer face 38 that is generally parallel to the longitudinal axis 31. The tissue roll 30 also has two opposing end faces 33 generally perpendicular to the outer face 32 and the longitudinal axis 31. An exemplary tissue roll 30 of bath tissue has an as-packaged roll height 52 of approximately 4.2 inches and an as-packaged roll diameter 54 of approximately 5.2 inches. In various aspects of the present invention, the tissue roll dimensions may be of any suitable size. An exemplary tissue roll 30 of paper towels has an as-packaged roll height 39 of approximately 11 inches and an as-packaged roll diameter 37 of approximately 4.6-6.0 inches.

Each tissue roll 30 is formed by winding a continuous web of tissue 32 around the longitudinal axis 31 to form an empty central bore 35 centered on the longitudinal axis 31. The tissue 32 may be wound around a tubular core diameter 34 or the tissue roll may be formed without a core. Due to the structure of the tissue roll 30, the tissue roll 30 has greater compressive strength in a direction along the longitudinal axis 31 than it does in a direction perpendicular to the longitudinal axis 31. A force in a direction perpendicular to the longitudinal axis 31 tends to have a crushing effect on the tissue roll 30 and can cause the central bore 35 to collapse or become partially or completely flattened.

While rolled tissue products may be packaged and sold individually, the present invention relates to packaging a plurality of rolled tissue products 30 with a package of tissue products 40 in a single unitary package 10. The package 10 may hold any suitable number of rolled tissue products 30. In one particular example the package 10 includes twenty rolled tissue products 30 in an array of three rolled tissue products 30 by two rolled tissue products 30 by four rolled tissue products 30. In the as-displayed orientation illustrated in FIG. 1, the package 10 generally has dimensions of three roll diameters wide, four roll heights high, and two roll diameters deep.

Generally the package comprises one or more rolled tissue products positioned adjacent to a packaged tissue product or a box body containing a packaged tissue product. The packaged tissue product generally comprises a package, such as a carton, container or dispenser, containing a stack of individual sheets. The package may be any of the packages known in the art and may be flexible, semi-rigid or rigid. Generally, as used herein the term "stacked tissue products" refers to individual sheets of material arranged in facing relation with one another to form a stack of sheet material. The individual sheets may comprise absorbent paper, tissue, nonwoven material or the like.

In a particularly preferred embodiment the packaged tissue product comprises a stack of pre-moistened wiping substrates disposed in a container. In certain embodiments the stack of tissue products are wet wipes, which are well known in the art. Wet wipes are typically pre-moistened with various compositions for ease in cleaning, disinfecting, and providing skin care benefits (e.g., moisturizing). Such stacks of wet wipes are typically placed within packages for shipping, storage, sale, and dispensing. As used herein, the term "wet wipe" for purposes of the present invention means a pre-moistened nonwoven web of fibers that can be used, for example, for cleansing purposes and includes items such as towelettes, wipes, e.g., baby wipes, hemorrhoid wipes, feminine hygiene wipes, bedridden patient wipes, bathroom cleaning wipes, and the like, and pre-moistened toilet paper.

The stack of wipes may be disposed in a dispensing carton, as is well known in the art. The carton typically includes an opening feature, which may be located at the top side or bottom side of the package. In some embodiments, the opening feature may intercept the top side and one of the other sidewalls of the package, so that the wet wipes may be dispensed in either a pop-up manner or a reach-in manner. In some embodiments, the opening feature may include a re-sealable feature, such as a lid or an adhesive flap. The lid may have a hinge (not shown) that allows for opening and closing of the lid.

Dispensing cartons for wet wipes are well known in the art and may be incorporated in the present invention. For example, in certain embodiments the packaged tissue product may be similar to that disclosed in U.S. Pat. No. 7,303,092 and include an outer carton having an opening in which an interior tub having a baffle and an aperture located in the baffle is disposed. A rigid flip top is disposed over the carton opening for access to the interior tub and a plurality of wet wipes is disposed within the interior tub beneath the baffle. In other embodiments the packaged tissue product may comprise a carton comprising a pop-up style dispensing means formed by a rigid port which surrounds a flexible, rubber-like material or sheet having one or more slits through which the wet wipes are dispensed, such as that disclosed in U.S. Pat. No. 6,523,690.

Figure 5:
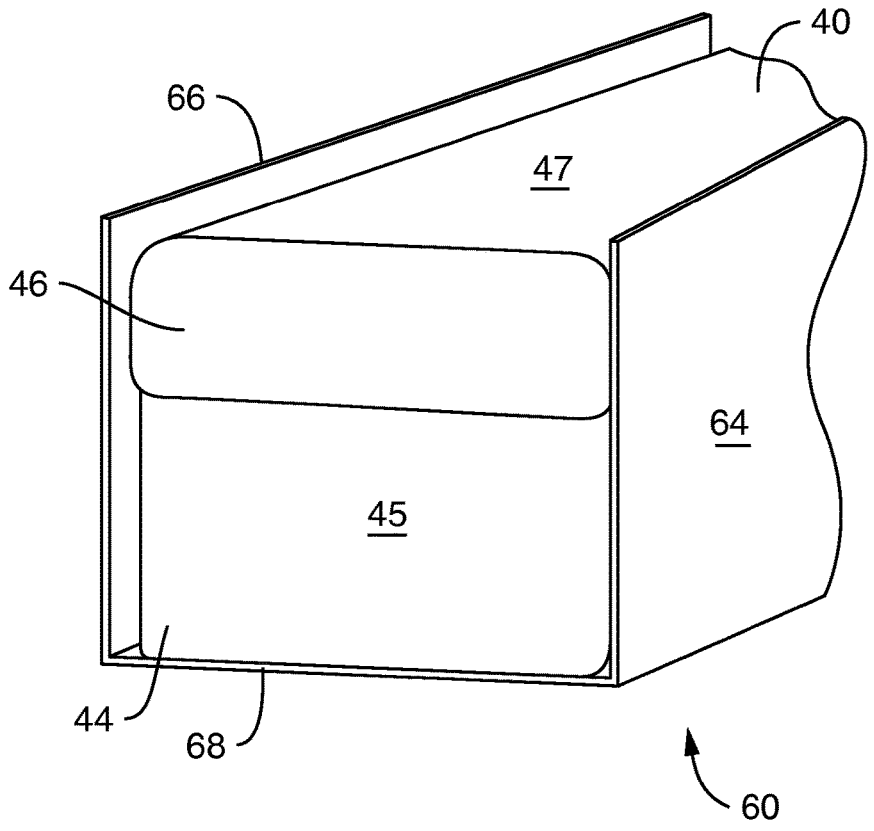
FIG. 5 is a perspective view of a wet wipe dispenser and box body that may be useful in assembling the package of the present invention.

Referring to FIG. 5, an exemplary wipes package 40 is illustrated in a right-side up orientation, which may be used to house a stack of wet wipes (not illustrated). The package 40 includes a tub 44 for receiving a stack of wet wipes and a lid 46. The upper face of the lid 46 forms the upper face 47 of the packaged tissue product 40. The tub 44 comprises a bottom side, a pair of opposed sidewalls, a front side and back side. The tub walls are typically freestanding and rigid, although in certain embodiments they may be semi-rigid or deformable. In those instances where the walls are deformable the package may take on a somewhat amorphous shape. Suitable materials for rigid tub walls are known in the art and may include HDPE and PP.

In other embodiments the packaged tissue product may comprise a stack of dry tissue sheets disposed in a carton, such as disclosed in U.S. Pat. No. 5,316,177. In such embodiments the packaged tissue product comprises a dispenser (also referred to as a carton) containing a plurality of individual tissue sheets that are dispensed through an opening. In this embodiment, the individual tissue sheets are prefolded or otherwise bunched/gathered together to further assist a child during toilet training. In this manner, the tissue sheets emerge from the dispenser in a condition ready for wiping.

As noted previously, in certain embodiments the overall stability of the package 10 may be increased by disposing the packaged tissue product 40 in a box body 60. The box body 60 houses the packaged tissue product 40. The box body 60 is packaged with rolled tissue products 30 and the goods are overwrapped with a packaging film 20 to form the unitary package 10. The box body may be formed from any materials commonly used in the art. In certain preferred embodiments the box body is composed of a paper carton (cardboard box). More specifically, the box body is configured by assembling a box by folding a flat cardboard at predetermined folding lines.

The box body may take any number of forms and is generally shaped to receive and house the packaged tissue product. For example, as illustrated in FIG. 5, the box body 60 may be three-sided and generally rectilinear. The illustrated box body 60 has a pair of opposed sidewalls 64, 66 and bottom wall 68 that are joined together to form a receptacle for the packaged tissue product 40. When the box body 60 of this embodiment is packaged the top face 47 of the packaged tissue product 40 may form the upper peripheral edge 19 of the package 10 and be contacted by the packaging film 20.

Figure 6:
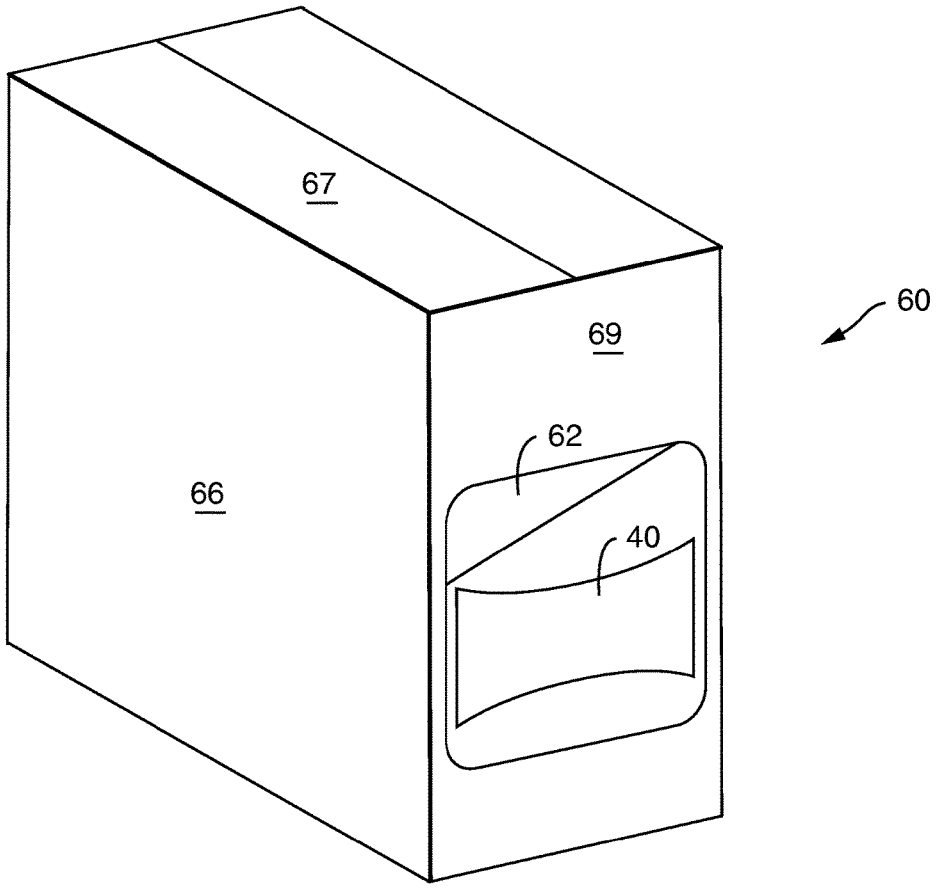
FIG. 6 is a perspective view of a wet wipe dispenser and box body that may be useful in assembling the package of the present invention.

In other embodiments, such as the embodiment illustrated in FIG. 6, the box body 60 has six faces, surfaces or panels—a bottom, a pair of opposed sides, a top, and back and front. Only the left side 66, top 67 and front 69 panels are illustrated in FIG. 6. To make the packaged tissue product 40 visible to the consumer the front face 69 may include a cut out or window 62. In certain embodiments the window 62 may be covered with a transparent film to provide viewing of the packaged tissue product 40, but to prevent damage during shipping and handling.

In other embodiments the box body lacks a front so as not to obscure the packaged tissue product. In still other embodiments the box body may lack a top so as to ease insertion of the packaged tissue product into the box body. In those embodiments where the box body lacks a top, the top face of the packaged tissue product may form the upper peripheral face of the package and be contacted by the packaging film.

In certain embodiments the package may be provided with a line of weakness, such as a perforation, on the bag to facilitate opening of the package. For example, in certain embodiments the front face of the packaging film may include a first perforated line. In a particularly preferred embodiment the line of weakness is formed along the upper portion of the front face and extends across both the rolled tissue products and the packaged tissue product.

Product information indicating type and the like of package contents may be provided on any of the package faces, although in certain embodiments it may be particularly preferred to provide product information on the front and opposing side faces. In certain preferred embodiments at least a portion of the package is translucent such that at least a portion of the rolled tissue products and packaged tissue products are visible through the packaging film.

In certain preferred embodiments, to enhance the stability of the package 10 and maintain a cubic shape, the packaged tissue product 40 is disposed in a box body 60 which is in-turn packaged with rolled tissue products 30 and overwrapped with film 20. In a particularly preferred embodiment, such as that illustrated in FIG. 3, the packaged tissue product 40, box body 60 and rolled tissue product 30 are packaged together such that the rolled tissue products 30 form a portion of each of the six faces of the package while the box body 60 only forms a portion of five faces of the package. Thus, in the illustrated embodiment, the top face 12 is formed by both the box body 60 and the rolled tissue product 30 while the bottom face is formed entirely of rolled tissue product 30. While in certain embodiments it may be preferred to have the packaged tissue product disposed in a box body the invention is not so limited. For example, in some embodiments the packaged tissue product may comprise a rigid cubic dispenser containing a stack of wet wipes that does not need to be packaged in a box body in order to form a stable, cubic package.

In those embodiments where the package 10 comprises a box body 60 the box body 60 may be arranged such that it forms a portion of one or more of the package's 10 peripheral edges. For example, in the illustrated embodiment the box body 60 forms a portion of the package's 10 upper peripheral edge 19. Further, as illustrated in FIG. 2 the box body 60 is illustrated as extending the package depth (d) and forming a portion of the front 18 and rear faces of the package. The position and dimension of the box body, however, are not limiting. Further, the inclusion of a box body 60 in the package 10 is not to be limiting. In certain embodiments the packaged tissue products 40 may be co-packaged with rolled tissue products 30 without disposing the packaged tissue products 40 in a box body 60.

Other arrangements of the packaged goods and rolled tissue products will be evident to those skilled in the art. Preferred arrangements are those in which at least one faces or face of the packaged tissue product or box body forms a portion of the package face. In this manner the packaged tissue product may be visible to a consumer. Particularly preferred arrangements are those arrangements in which the box body forms a portion of a least two different faces of the package and even more preferred are those arrangements in which the box body forms a portion of a least two different faces and is contacted by at least three different rolled tissue products.

In those embodiments where the packaged tissue product are not disposed in a box body the foregoing arrangements are contemplated, with the exception that certain faces or faces of the packaged tissue product may form a portion of one or more package faces or faces and may contact the rolled tissue products.

To form the package of the present invention, in certain embodiments, both ends of a flat sheet of film are joined to form a tube-shape with both ends of which are opened. Next, the rolled tissue product and packaged tissue product are inserted into the tube-shaped film. Thereafter, a first end side and a second end side of the tube-shaped film are joined and sealed to form the packaging film, which overwraps both the rolled tissue products and the packaged tissue products.

We claim:

1. A package of tissue products having a top face, a bottom face, a first side face, a second side face, a front face and a back face, the package comprising a packaged tissue product comprising a cubic carton and a tissue product disposed therein, rolled tissue products and a packaging film covering at least a portion of the packaged tissue product and at least one of the rolled tissue products, wherein at least a portion of the top face, front face and back face of the package are formed by the packaged tissue product and the rolled tissue products.

2. The package of claim 1 wherein the package comprises at least five rolled tissue products and the packaged tissue product is contacted by at least three of the five rolled tissue products.

3. The package of claim 1 wherein the package includes a front width, a package front height, and a package bottom depth, and wherein the plurality of tissue rolls are oriented in an array such that the package front width is equivalent to three roll widths, the package front height is equivalent to four roll heights, and the package bottom depth is equivalent to two roll diameters and the packaged tissue product contacts at least six rolled tissue products.

4. The package of claim 1 wherein the packaging film overwraps all of the rolled tissue products and the packaged tissue product.

5. The package of claim 4 wherein the packaging film comprises an upper sealed portion and bottom sealed portion.

6. The package of claim 1 wherein the packaging film comprises a line of weakness.

7. The package of claim 1 wherein the cubic carton comprises a lid and the tissue product comprises a plurality of pre-moistened wipes stacked in facing arrangement with one another.

8. The package of claim 1 wherein the tissue product comprises a plurality of dry tissue sheets stacked in facing arrangement with one another.

9. A package of tissue products having a top face, a bottom face, a first side face, a second side face, a front face and a back face, the package comprising a plurality of rolled tissue products, a cubic box body having top and bottom walls, a pair of opposed sidewalls and front and rear walls, the front wall having an opening disposed thereon, a packaged tissue product disposed in the box body and at least partially visible through the opening in the box body front wall, and a packaging film disposed over at least a portion of the box body and the rolled tissue products, wherein at least a portion of the top face and the front face of the package are formed by the box body and the rolled tissue products.

10. The package of claim 9 wherein at least a portion of the back face is formed by the box body and the rolled tissue products.

11. The package of claim 9 wherein the packaging film overwraps all of the rolled tissue products and the box body.

12. The package of claim 9 wherein the packaged tissue product comprises a carton, a lid and a plurality of pre-moistened wipes stacked in facing arrangement with one another disposed in the carton.

13. The package of claim 9 wherein the packaged tissue product comprises a carton and a plurality of dry tissue sheets stacked in facing arrangement with one another disposed in the carton.

14. A package of tissue products having a top face, a bottom face, a first side face, a second side face, a front face and a back face, the package consisting essentially of a plurality of rolled tissue products, a box body having a bottom wall and a pair of opposed sidewalls, a packaged tissue product comprising a cubic carton and a plurality of tissue products disposed therein disposed in the box body and a packaging film continuously overwrapping the box body, packaged tissue product and rolled tissue products, wherein at least a portion of the top, front and back faces of the package are formed by the packaged tissue product and the rolled tissue products.

15. The package of claim 14 wherein the cubic carton comprises a lid and the tissue product comprises a plurality of pre-moistened wipes stacked in facing arrangement with one another.

* * * * *